United States Patent [19]

Mukhtar et al.

[11] Patent Number: 4,696,727

[45] Date of Patent: Sep. 29, 1987

[54] UNIVERSAL SELECTIVE PLATING HEAD

[75] Inventors: Saad Mukhtar, San Jose; Syed A. Husain, Fremont, both of Calif.

[73] Assignee: Automated Semiconductor, Inc., San Jose, Calif.

[21] Appl. No.: 929,721

[22] Filed: Nov. 12, 1986

[51] Int. Cl.[4] ..... C25D 17/00

[52] U.S. Cl. ..... 204/206; 204/224 R

[58] Field of Search ..... 204/206, 224 R

[56] References Cited

U.S. PATENT DOCUMENTS 4,029,555 6/1977 Tezuka ..... 204/206

*Primary Examiner*—T. M. Tufariello

*Attorney, Agent, or Firm*—Law Office of Thomas E. Schatzel

[57] ABSTRACT

A selective plating apparatus having a multipitch centerline feed block for delivering a uniform blade of plating solution to a mask and which provides passageways for the drainage of used electrolyte solution. The delivery of a uniform blade of plating solution to the mask allows the mask to be designed such that it controls both the area of sample to be plated and the pitch of the sample.

6 Claims, 9 Drawing Figures

UNIVERSAL SELECTIVE PLATING HEAD

BACKGROUND OF THE INVENTION

1. Field of the Invention

The present invention relates to metal spot plating systems which allow a continuous web of metal to be selectively plated at regular and discrete intervals. More particularly, this invention relates to such a planing system in which the region to be plated can be varied with a minimum of retooling.

2. Description of the Prior Art

Integrated circuits are combinations of interconnected circuit elements housed in a suitable matrix and mounted of a metal plated pad. The manufacturing process for mass producing integrated circuits generally involves a step wherein many identical lead frames are covered or plated with a metal coating. Automated, selective plating systems, such as described in U.S. Pat. No. 3,723,283, have been developed which allow continuous strips or webs of lead frames to be passed through the system while selected areas on the lead frame are uniformly plated with metal. Much prior art has focused on optimizing various parameters of the automated electroplating process . U.S. Pat. No. 4,405,432, for example, teaches the use of a large planar electrode which results in faster and higher quality plating. U.S. Pat. No. 4,409,924 describes a plating apparatus which automatically aligns the web prior to plating.

A major problem with current selective plating systems is that extensive retooling of the system must be conducted whenever a new plating operation is undertaken. This retooling is necessary because plating systems of the prior art generally employ dedicated electrolyte delivery systems which are specifically designed for an individual job. In these systems, a mask containing a specific pattern of apertures is used to expose the individual regions of the web to be plated. Electrolyte solution is then injected at each mask aperture to accomplish the selective plating. Because of this configuration, retooling involves redesigning both the mask and the nozzle block which contains the electrolyte delivery system. The cost of retooling a selective plating system for a new job is a significant part of the total bid for the new project.

Another problem with selective plating systems of the prior art is that the rate at which the electroplating process occurs is limited by the rate at which used electrolyte solution can be removed from the plating area. This necessitates longer plating periods.

SUMMARY OF THE PRESENT INVENTION

It is therefore an object of the present invention to provide an improved selective plating system which utilizes a universal plating head.

It is another object of the present invention to provide an improved selective plating system which utilizes an insert blade.

It is another object of the present invention to provide an improved selective plating system which utilizes an efficient drainage insert.

Briefly, a preferred embodiment of the present invention includes a standard plating head which contains a multipitch centerline feed block, and a mask. The multipitch centerline feed block comprises an electrode, a universal nozzle block, an insert blade and a drain insert. The insert blade contains a number of specially designed jets opening in a narrow channel which deliver a uniform blade of electrolyte solution. The insert blade also contains two channels for accepting a screen electrode. The drain insert contains a number of raised landings which support the mask and which also provide drainage pathways for spent electrolyte solution. The mask contains a pattern of apertures designed to control both the discrete area to be plated and to control the repeating pitch of the particular plating job.

An advantage of the present invention is that retooling between different plating jobs is limited to redesigning the mask.

Another advantage of the present invention is that the insert blade provides a uniform blade of electrolyte solution thereby yielding more uniform plating and making simplified retooling possible.

Another advantage of the present invention is that the drain insert provides rapid drainage of spent electrolyte thereby increasing the rate of plating.

These and other objects and advantages of the present invention will no doubt become apparent to those skilled in the art after having read the following detailed description of the preferred embodiment which is illustrated in the various figures of the drawing.

IN THE DRAWINGS

Figure 3:
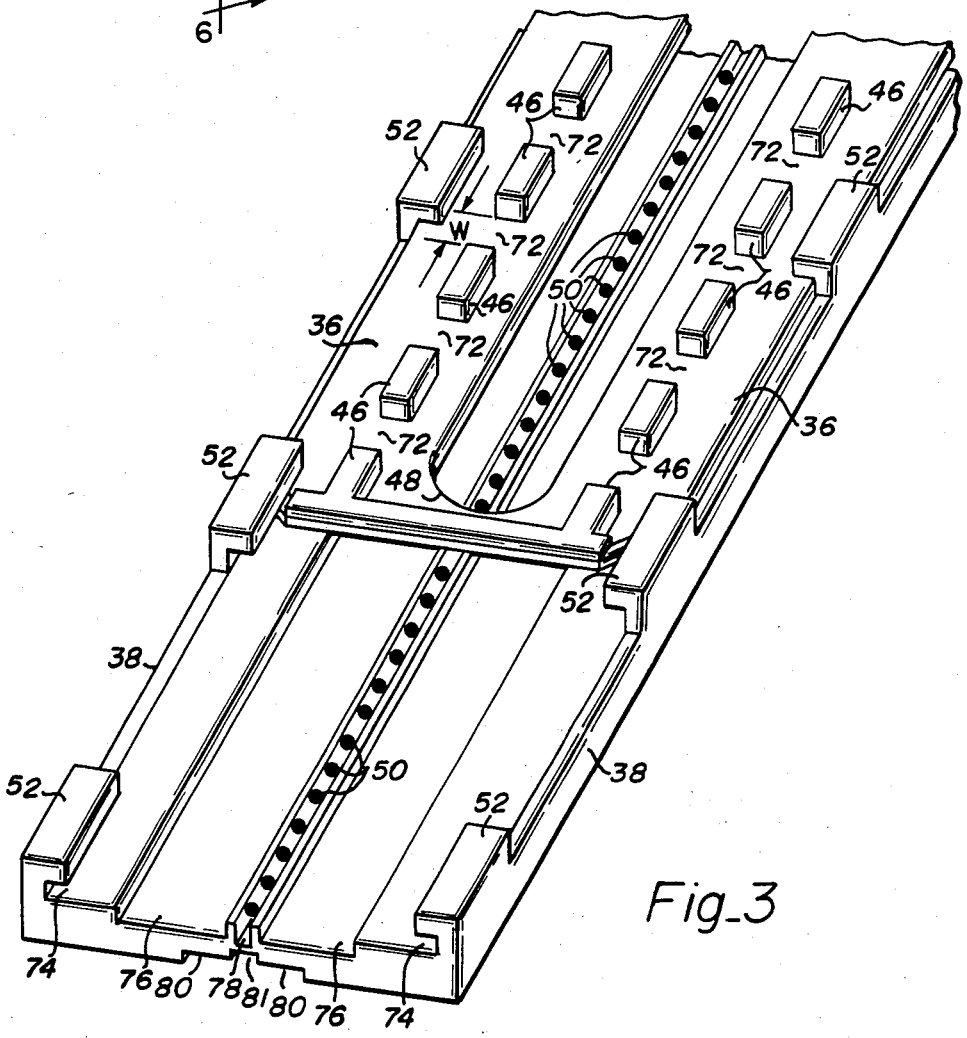
FIG. 3 is a perspective view of the drain insert and insert blade shown with the drain insert partially retracted.
Figure 4A:
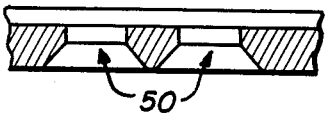
Figure 4B:
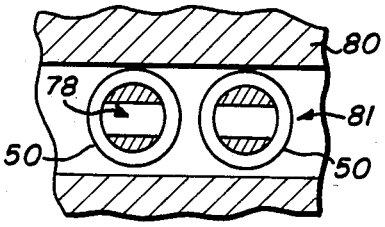

FIG. 4*a* illustrates a side cross-sectional view of a pair of jets shown in FIG. 3;

FIG. 4*b* illustrates the back view of the pair of jets shown in FIG. 4*a;*

Figure 4C:
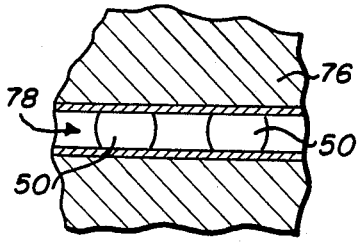

FIG. 4*c* illustrates the front view of the pair of jets shown in FIG. 4*a;*

Figure 2:
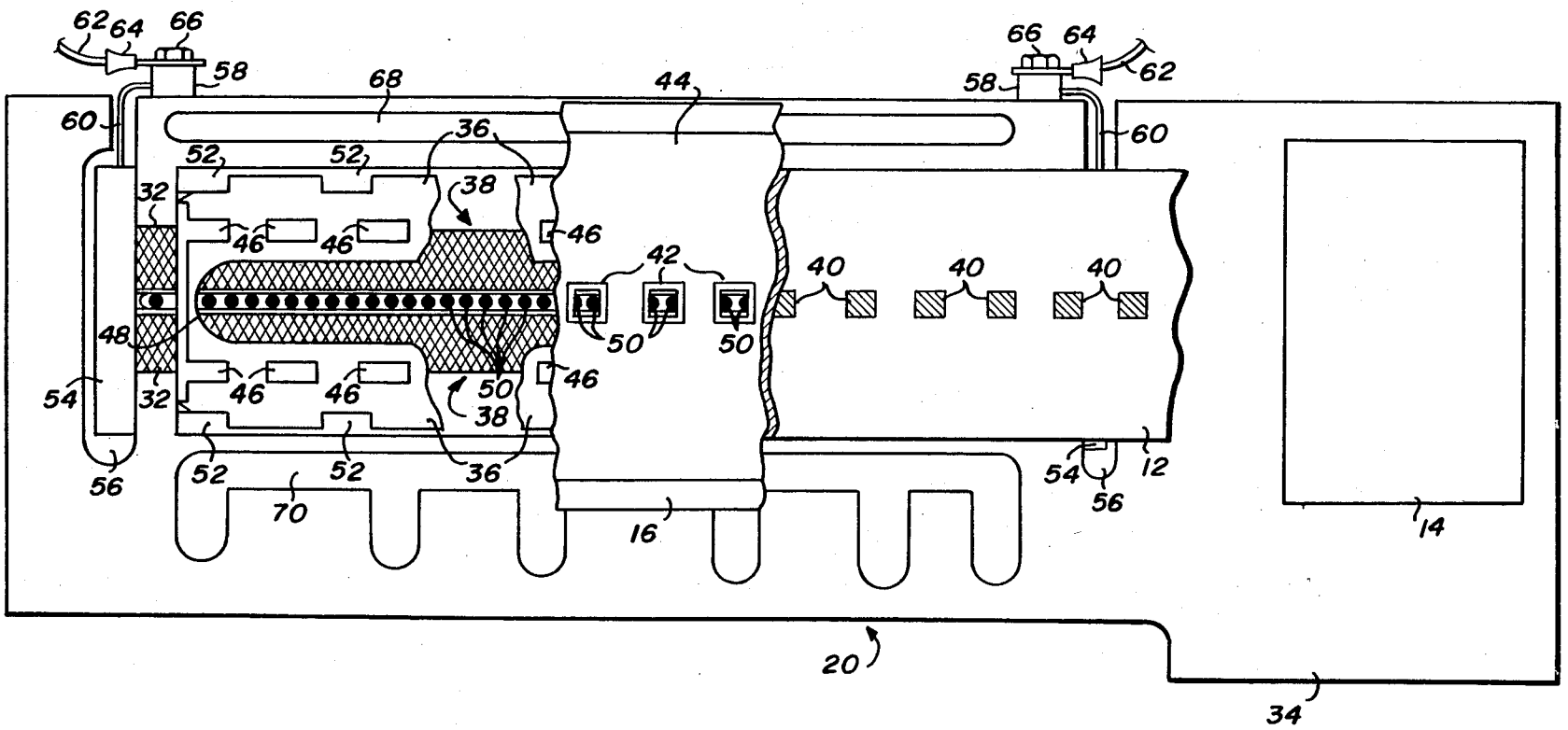
FIG. 2 is a partial cross-sectional view of the universal selective plating head taken along the line 2—2 of FIG. 1, with portions of the web, mask and drain insert cut away to illustrate the internal relationship of these elements and to expose the underlying screen electrode and jets.
Figure 5A:
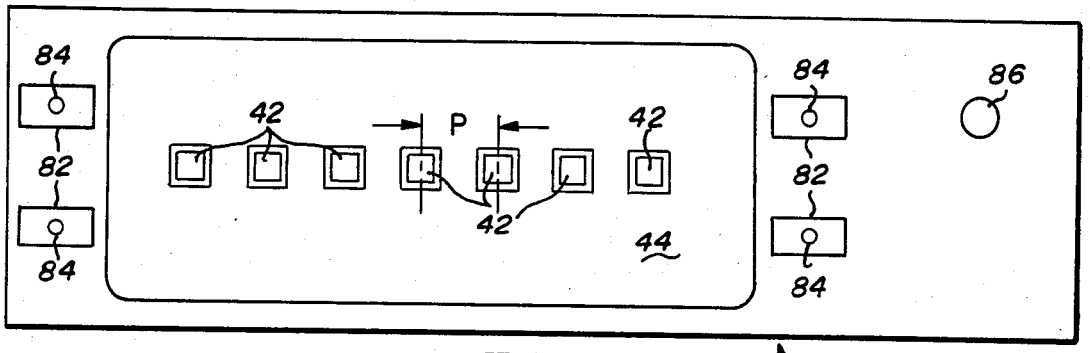
Figure 5B:
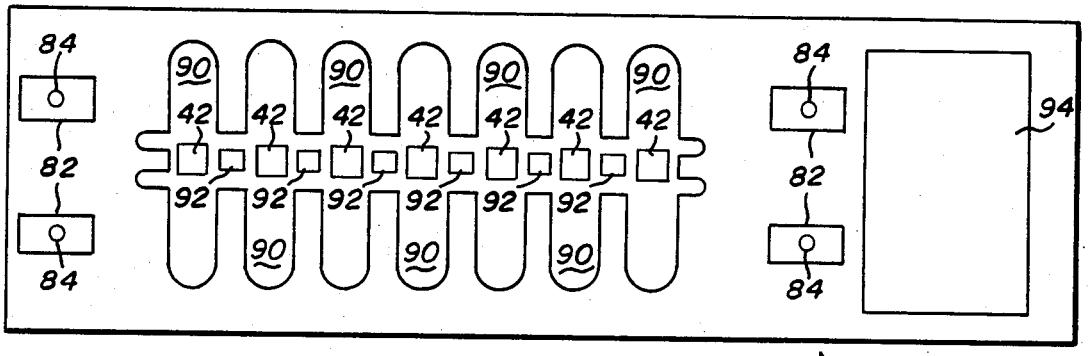

FIG. 5*a* illustrates the front of the mask shown in FIG. 2;

FIG. 5*b* illustrates the back of the mask shown in FIG. 2; and

Figure 1:
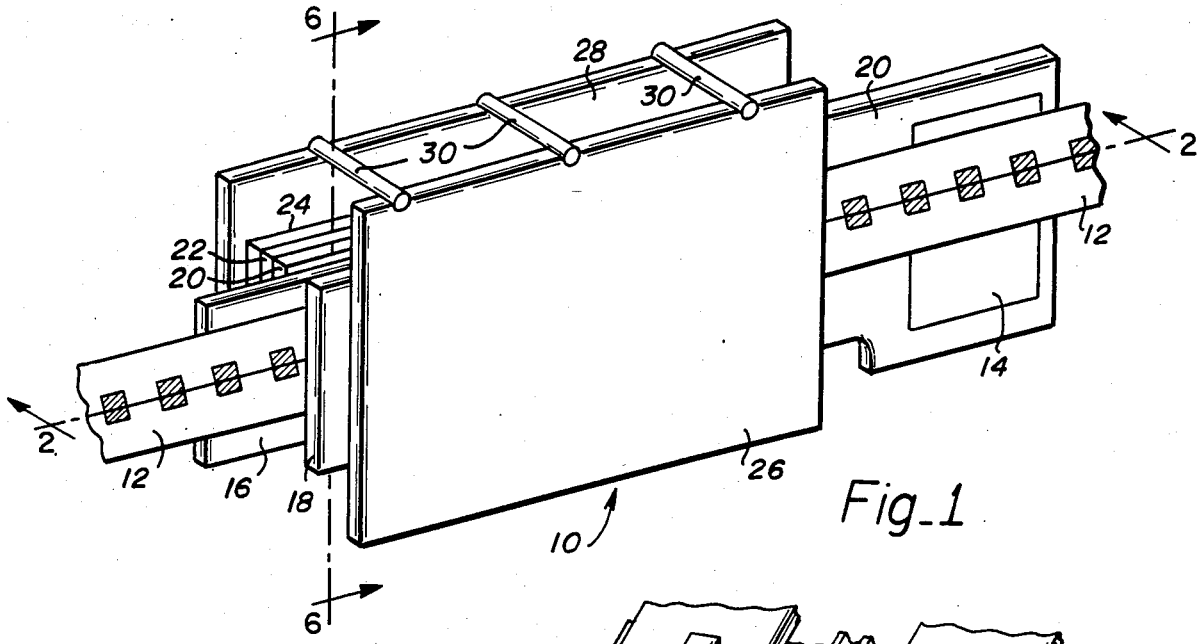
FIG. 1 illustrates a universal selective plating head according to the present invention.
Figure 6:
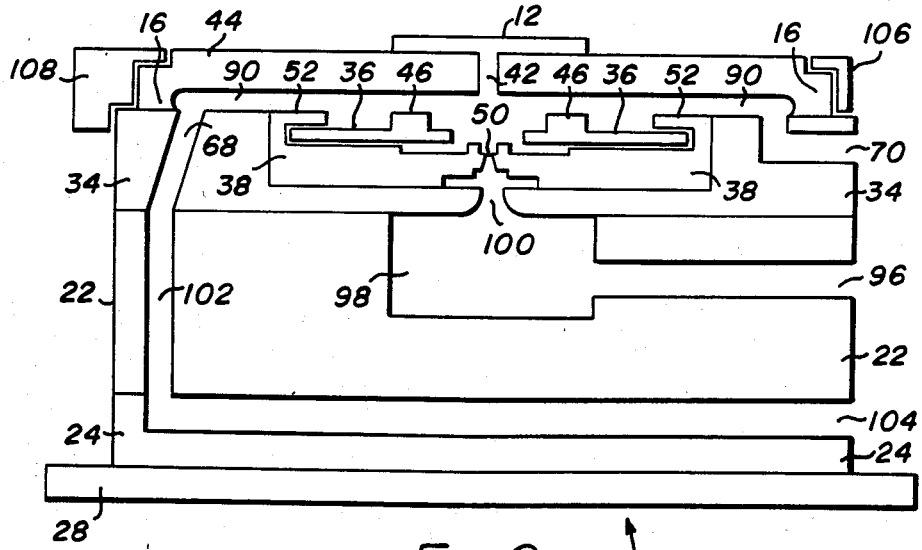

FIG. 6 is a partial cross-sectional view of the universal selective plating head taken along the line 6—6 of FIG. 1.

DETAILED DESCRIPTION OF THE PREFERRED EMBODIMENT

FIG. 1 shows an assembled universal plating head of the present invention designated by the general reference numeral 10. In operation, a web 12 is pulled into the plating head 10 and aligned for plating by a standard strip aligning mechanism 14 such as that described in U.S. Pat. No. 4,409,924. Inside of head 10, web 12 encounters and is pressed firmly against a mask 16 by a pressure pad assembly 18. Positioned directly behind mask 16 is a multipitch centerline feed block 20. Behind the multipitch centerline feed block 20 is a manifold 22 and behind manifold 22 is a drain plate 24. A front mounting plate 26 and a back mounting plate 28 form the external frame of plating head 10. A plurality of tie rods 30 connect front mounting plate 26 and back mounting plate 28.

FIG. 2 shows a sectioned view of the multipitch centerline feed block 20 with web 12 and mask 16 properly positioned. The multipitch centerline feed block 20 is comprised of two screen electrodes 32, a universal nozzle block 34, a drain insert 36 and an insert blade 38. A plurality of plating sites 40 are aligned directly over a plurality of mask apertures 42 by the strip aligning mechanism 14. Mask 16 is wider than web 12 and contains a rubber area 44. Mask 16 is supported, on its underside, by a plurality of raised landings 46 which are located on the surface of drain insert 36. An oval-shaped space 48 is cut into the midsection of drain insert 36 to expose the underlying screen electrodes 32 and a plurality of jets 50 which lie in channels cut into the surface of insert blade 38 (see FIG. 3). A plurality of cleats 52 provide a means for slidably connecting drain insert 36 to insert blade 38. The screen electrode 32 is attached to a pair of electrode posts 54 which sit in a pair of cavities 56 cut into the universal nozzle block 34. Electrode posts 54 are electrically connected to a pair of electrode studs 58 by a pair of pure platinum wires 60. Positive voltage is supplied to electrode studs 58 by a pair of voltage leads 62 each of which are secured by a clamp 64 and a screw 66. An upper drain cavity 68 and a lower drain cavity 70 are also cut into nozzle block 34.

FIG. 3 shows drain insert 36 and insert blade 38 in more detail. In FIG. 3, the drain insert 36 is shown partially retracted from insert blade 38 so as to reveal the front surface of insert blade 38. Raised landings 46 are located on the outside surface of drain insert 36. A plurality of drainage gaps 72, having width "w", are formed by adjacent pairs of raised landings 46 and the oval-shaped space 48 is cut about the middle of drain insert 36.

The insert blade 38 contains a pair of slots 74, formed by cleats 52, into which the drain insert 36 can snuggly slide. Below slots 74 are a pair of channels 76 which are designed to accept the screen electrode 32 (shown in FIG. 2) and a narrower and deeper centerline channel 78, into which open a plurality of the jets 50. An additional set of channels, 80 and 81, are cut into the back surface of insert blade 38.

FIGS. 4*a*, *b* and *c* show the shape of a representative pair of jets 50 from three different prospectives. FIG. 4*a* shows that jets 50 are countersunk, cylindrical holes having a flare at one end. FIG. 4*b* shows that the larger flared ends of jets 50 open in channel 81 on the back surface of insert blade 38. FIG. 4*c* shows the smaller cross-sectional area ends of jets 50 opening in centerline channel 78 on the front surface of insert blade 38.

FIG. 5*a* shows the front side of mask 16 which fits against the web 12. The rectangular rubber area 44 provides a tight seal between the mask 16 and web 12. The apertures 42 are designed to control the shape of the region to be plated while the distance, p, known as the pitch, corresponds to the repeating distance between the plating sites 40 on web 12. A plurality of strip guides 82 and a plurality of guide pins 84 function to guide the web 12 as it moves over mask 16. A locating pin 86 provides for aligning the web 12 and mask 16 so that the pitch is correct.

FIG. 5*b* shows the backside of mask 16 which fits against the drain insert 36 of the multipitch centerline feed block 20. Around each aperture 42, a backcut 90 has been channeled out with a plurality of islands 92 left in place. An element 94 is a pawl plate.

FIG. 6 shows a partial cross-sectional view of the universal plating head 10. Plating fluid enters plating head 10 through an inlet channel 96 and flows to a reservoir 98. Plating solution then surges out of reservoir 98 through a hole 100 cut into the back of nozzle block 34 and through jet 50 and mask aperture 42. After striking web 12, plating solution drains through back-cuts 90, upper drain cavity 68 and lower drain cavity 70. Plating solution draining through upper drain cavity 68 exits the plating head through a manifold drain cavity 102 and a drain plate cavity 104. A clamp 106 and a clamp 108 secure mask 16 to nozzle block 34.

The design of the jets 50 and their relation to the centerline channel 78, shown in FIG. 4, are significant to the functioning of the universal selective plating head 10 because these elements ensure that a uniform blade of electrolyte solution will be delivered to the mask apertures 42. In the functioning apparatus, electrolyte solution enters channel 81 through hole 100 in nozzle block 34. The electrolyte solution then enters the large openings of jets 50. Because the cross-sectional area of jets 50 decreases within the jets, a uniform back pressure of fluid builds up in each jet. Thus, when electrolyte solution emerges from the small openings of jets 50 it completely fills centerline channel 78 and creates a uniform "blade" of electrolyte solution as opposed to discrete "streams" of solution. In the preferred embodiment of the present invention, an adequate back pressure of fluid to obtain the blade is assured by constructing the jets 50 such that the summation of the cross-sectional areas of the jets is greater than the total area of centerline channel 78. When an adequate back pressure is achieved, the uniform blade of electrolyte solution will impinge mask 16 and deliver a uniform volume of electrolyte solution to each aperture 42. This uniform delivery of electrolyte solution, in combination with the uniform amount of current delivered by screen electrode 37, results in uniform plating occurring at each plating site 40 and makes possible the incorporation of the pitch control function into the design of mask 16.

The design of the drain insert 36 is significant to the present invention. Once electrolyte solution has been delivered to an aperture 42, the concentration of metal ions in that particular volume of solution is quickly depleted. The maximum rate of plating will be achieved if the spent electrolyte solution can be rapidly drained away from apertures 42. In the present invention, rapid drainage is achieved by placing raised landings 46 on drain insert 36. Immediately after entering apertures 42, spent electrolyte solution is flushed out of the apertures by the steady stream of fresh electrolyte solution. The spent solution fills the back-cuts 90 located on the backside of mask 16 and is rapidly drained away via drainage gaps 72 which are formed by raised landings 46. The spent electrolyte solution then exits the plating head 10 via drain cavities 68 and 70 in nozzle block 34.

A second advantage associated with drain insert 36 is that the drainage gaps 72 alleviate back pressure which may otherwise build up around plating sites 40 and cause electrolyte solution to leak around the apertures 42 and plate out in undesirable locations.

In the preferred embodiment of the present invention, universal nozzle block 34, drain insert 36, insert blade 38 and mask 16 are all made of fiberglass G-10. The screen electrode 32 and wires 60 are made of platinum. The electrode studs 58 are titanium. Mask 16 also contains a silicone rubber strip 44, aluminum oxide guide pins 84, fiberglass G-10 strip guides 82 and the element 94 is made of glass-filled polyphenylene oxide.

Although the present invention has been described in terms of the presently preferred embodiment, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

We claim:

1. A universal selective plating head comprising:

a masking means for controlling the area and the pitch of a sample to be plated, said masking means including a plurality of mask apertures; and a multipitch centerline feed block including a universal nozzle block and an electrode with said electrode extending lengthwise along the feed block, and means for spraying a uniform blade of plating solution on said masking means, said means for spraying comprising an insert blade and a drain insert, said insert blade including a first channel containing a plurality of jets for spraying the uniform blade of plating solution on the masking means, and a second and a third channel situated on either side of said first channel for receiving said electrode, and said drain insert adapted to slidably fit inside of said insert blade and over said first, second and third channels, and including a space cut into said drain insert for allowing exposure of said electrode and uniform blade of plating solution to the masking means, said drain insert also including a plurality of raised landings to create drainage passageways through which plating solution can drain away from the masking means after spraying.

2. The universal selective plating head of claim 1 wherein, said jets are countersunk, cylindrical holes having a flared end.

3. The universal selective plating head of claim 2 wherein, said jets have their larger diameter side facing away from the masking means and with the total cross-sectional area of the holes on said larger diameter side being greater than the total cross-sectional area of said first channel; and whereby the difference in cross-sectional areas between said holes and said first channel results in a back pressure of said plating solution on the backside of said insert blade which causes said plating solution to move through said jets under pressure.

4. The universal selective plating head of claim 3 wherein, the spacing of said jets is independent of the sample to be plated.

5. The universal selective plating head of claim 4 wherein, apertures are cut in the masking means in a shape to control the area to be plated and at a pitch to control a repeating pattern to be plated.

6. The universal selective plating head of claim 5 wherein, said drainage passageways are of sufficient cross-sectional area to prevent a back pressure of plating solution from developing in said apertures in the masking means.

* * * * *